US008112980B2

(12) United States Patent
Tatemoto et al.

(10) Patent No.: US 8,112,980 B2
(45) Date of Patent: Feb. 14, 2012

(54) FINISH FOR SYNTHETIC FILAMENT YARN PROCESSED IN FRICTION FALSE-TWIST TEXTURING AND APPLICATION THEREOF

(75) Inventors: Shinichi Tatemoto, Osaka (JP); Tatsuo Harada, Osaka (JP); Kaori Kimoto, Osaka (JP)

(73) Assignee: Matsumoto Yushi-Seiyaku Co., Ltd., Osaka (JP)

( * ) Notice: Subject to any disclaimer, the term of this patent is extended or adjusted under 35 U.S.C. 154(b) by 99 days.

(21) Appl. No.: 12/677,253

(22) PCT Filed: Sep. 2, 2008

(86) PCT No.: PCT/JP2008/002393

§ 371 (c)(1),
(2), (4) Date: Mar. 9, 2010

(87) PCT Pub. No.: WO2009/034692

PCT Pub. Date: Mar. 19, 2009

(65) Prior Publication Data

US 2010/0199624 A1 Aug. 12, 2010

(30) Foreign Application Priority Data

Sep. 10, 2007 (JP) ..... 2007-233973
Feb. 26, 2008 (JP) ..... 2008-044485

(51) Int. Cl.
*D01H 13/30* (2006.01)

(52) U.S. Cl. ..... 57/292

(58) Field of Classification Search ..... 57/286, 57/292; 8/115.6, 115.54
See application file for complete search history.

(56) References Cited

U.S. PATENT DOCUMENTS

2007/0192965 A1 * 8/2007 Komeda et al. ..... 8/115.51

FOREIGN PATENT DOCUMENTS

| | | | |
|---|---|---|---|
| JP | 02-269878 | | 11/1990 |
| JP | 08-325949 | | 12/1996 |
| JP | 10-072783 | | 3/1998 |
| JP | 10-131055 | | 5/1998 |
| JP | 2000-080561 | | 3/2000 |
| JP | 2002161474 | A * | 6/2002 |
| JP | 2003-171879 | | 6/2003 |
| JP | 2003-213571 | | 7/2003 |
| JP | 2003-313773 | | 11/2003 |
| JP | 2004-124354 | | 4/2004 |
| JP | 2004-292961 | | 10/2004 |
| JP | 2006-233405 | | 9/2006 |

* cited by examiner

*Primary Examiner* — Shaun R Hurley
(74) *Attorney, Agent, or Firm* — Carrier Blackman & Associates, P.C.; William D. Blackman; Joseph P. Carrier

(57) ABSTRACT

A finish for synthetic filament yarn which decreases broken filaments and ends down in friction false-twist texturing includes 40 to 98 wt % of a polyether compound, and essentially comprises components (A) and (B); wherein the component (A) is at least one member selected from the group consisting of (A1) a $C_1$-$C_{10}$ fatty acid, (A2) a $C_1$-$C_{10}$ hydroxyfatty acid, (A3) a sarcosine derivative, and salts thereof, and the amount of the component (A) in the finish ranges from 0.05 to 5 wt %; and wherein the component (B) is an alkylphosphate salt and the amount of the component (B) in the finish ranges from 0.01 to 3 wt %.

16 Claims, No Drawings

FINISH FOR SYNTHETIC FILAMENT YARN PROCESSED IN FRICTION FALSE-TWIST TEXTURING AND APPLICATION THEREOF

TECHNICAL FIELD

The present invention provides a finish for synthetic filament yarn processed in friction false-twist texturing, and application thereof. More specifically, the present invention provides a finish for synthetic filament yarn suitable to be processed in friction false-twist texturing, finish-application emulsion of the finish, synthetic filament yarn applied with the finish, manufacturing process of the synthetic filament yarn, and resultant yarn.

TECHNICAL BACKGROUND

False-twist textured synthetic filament yarn is manufactured with a false-twist texturing machine which heats finish-applied synthetic filament yarn with its heating device, and then processes the yarn in simultaneous twisting and drawing with its false-twisting device. False-twist texturing machines fall into two types; a non-contact heating type which heats synthetic filament yarn with radiation heat from a high temperature heater (hereinafter referred to as a non-contact type false-twist texturing machine), and a contact heating type which heats synthetic filament yarn being contacted on a heater (hereinafter referred to as a contact type false-twist texturing machine).

A non-contact type false-twist texturing machine is apt to result in broken filaments and ends down due to its high-speed false-twist texturing operation. The major cause of the broken filaments and ends down in a process with a non-contact type false-twist texturing machine is the load given to synthetic filament yarn in high-speed drawing and false-twist texturing, because such load increases breakage of monofilaments.

On the other hand, a contact type false-twist texturing machine has been increasingly employed for processing various yarns along with the recent diversification in false-twist textured yarns represented by fine-denier yarns, full-dull polymer yarns, yarns of modified cross sections, and yarns spun of multicomponent polymer, all of which are applied with higher amount of finishes or apt to generate fiber waste in texturing so as to increase broken filaments and ends down. Those yarns also shorten the cleaning intervals for heaters of texturing machines to hinder high-speed texturing operation. Broken filaments and ends down in texturing with a contact type false-twist texturing machine are also caused by the load given to synthetic filament yarn of low monofilament tenacity that accelerates breakage of monofilaments. One of the causes of the load given to synthetic filament in texturing process is stain on heater surface resulted from finishes and fiber waste.

For solving these problems, several methods (for example, those in Patent References 1 to 4) have been suggested. Those methods provide finishes applicable to yarns to be textured with both contact and non-contact type false-twist texturing machines, and the finishes contain fluorine compounds which function to decrease the surface tension of the finishes in a specified temperature range so as to prevent broken filaments and ends down. Another method for solving the problems (for example, the method in Patent Reference 5) provides a finish which is formulated by combining a polyether and ether ester each having a M.W. in a specified range and attains stable false-twist texturing to decrease broken filaments. Furthermore, finishes containing polyether compounds and specific polyorganosiloxanes (for example, those in Patent References 6 and 7), and a finish containing a secondary alcohol or its derivative (for example, that in Patent Reference 8) have been suggested for texturing with a contact type false-twist texturing machine.

The fluorine compounds in finishes disclosed in Patent References 1 to 4, however, excessively decrease the surface tension of finishes to cause finish emulsion to be thrown off from yarn and result in insufficient amount of finish on yarn so as to fail to sufficiently prevent broken filaments and ends down. In addition, the fluorine compounds increased the cost of the finishes to disturb their practical use. Furthermore, the finishes containing the fluorine compounds could not sufficiently prevent broken filaments and ends down in texturing with a contact type false-twist texturing machine, because the fluorine compounds in finishes evaporated on the heater plate of a contact type heater before the compounds exert their effect.

The method in Patent Reference 5 failed to uniformly coat filament surface, and resulted in insufficient filament cohesion which leads to varied yarn tension in false-twist texturing, broken filaments, and ends down.

Finishes represented by those disclosed in Patent References 6 and 7 could not decrease stain on heater surface which was caused from finishes thrown off from filament yarn in false-twist operation to be stuck on heater surface, and resulted in broken filaments and ends down due to the stain. A finish represented by that disclosed in Patent Reference 8 formed weak finish film on filament surface to attain poor filament cohesion, and could not sufficiently prevent broken filaments and ends down.

Those finishes seriously decreased their flowability at the initial stage of heating yarn on heater surface (for example, the finishes in Patent References 1 to 5 and 8), or left hard finish residue on heater surface due to the increased amount of finish accumulated on heater surface for a long term of texturing (for example, the finishes in Patent References 6 and 7) so as to fail to sufficiently prevent broken filaments and ends down. Some finishes exhibiting good flowability at the initial stage of heating left high amount of finish residue on heater surface and failed to sufficiently prevent stain on heater surface.

[Patent Reference 1] JP A 2003-213571
[Patent Reference 2] JP A 2004-124354
[Patent Reference 3] JP A 2000-080561
[Patent Reference 4] JP A 2004-124354
[Patent Reference 5] JP A 08-325949
[Patent Reference 6] JP A 10-131055
[Patent Reference 7] JP A 10-072783
[Patent Reference 8] JP A 2003-313773

DISCLOSURE OF INVENTION

Technical Problem

The present invention aims to provide a finish for synthetic filament yarn processed in friction false-twist texturing, which decreases broken filaments and ends down and prevents stain on heater, especially the stain on heater surface occurring in heating synthetic filament yarn being contacted to a heater; finish-application emulsion of the finish; synthetic filament yarn applied with the finish; manufacturing process of the synthetic filament yarn; and resultant yarn.

Technical Solution

The inventors of the present invention have studied diligently, and found that a finish for synthetic filament yarn processed in friction false-twist texturing comprising 30 to 98 wt % of a polyether compound and essentially comprising components (A) and (B) each in a specified amount decreases broken filaments and ends down in false-twist texturing a synthetic filament yarn applied with the finish with a contact type false-twist texturing machine or a non-contact type false-twist texturing machine, so as to achieve the present invention.

The finish for synthetic filament yarn processed in friction false-twist texturing of the present invention comprises 30 to 98 wt % of a polyether compound and essentially comprises the components (A) and (B); wherein the component (A) is at least one member selected from the group consisting of (A1) a $C_1$-$C_{10}$ fatty acid, (A2) a $C_1$-$C_{10}$ hydroxyfatty acid, (A3) a sarcosine derivative, and their salts, and constitutes 0.05 to 5 wt % of the finish, and the component (B) is an alkyl phosphate salt and constitutes 0.01 to 3 wt % of the finish.

The finish preferably contains a component (C) which is an aliphatic dibasic acid and/or its salt and constitutes 0.01 to 3 wt % of the finish.

The component (A1) should preferably be a compound represented by the following formula (1), the component (A2) should preferably be a compound represented by the following formula (2), and the component (A3) should preferably be a compound represented by the following formula (3):

[Formula 1]

$$R^1—(CH_2)_l—COOH \quad (1)$$

where $R^1$ is a hydrogen atom or methyl group, and l is an integer ranging from 0 to 8;

[Formula 2]

$$R^2—(CH)(OH)—COOH \quad (2)$$

where $R^2$ is a hydrogen atom, $C_1$-$C_8$ alkyl group, or $C_1$-$C_8$ alkenyl group;

[Formula 3]

$$R^3—N(CH_3)—CH_2—COOH \quad (3)$$

where $R^3$ is a hydrogen atom, $C_1$-$C_{34}$ alkyl group, $C_1$-$C_{34}$ alkenyl group, or $C_1$-$C_{34}$ acyl group.

The component (A) should preferably be the component (A2) and/or its salt.

The component (B) should preferably be an alkyl phosphate salt of $C_8$-$C_{32}$ alcohol or an alkyl phosphate salt of an alkylene oxide adduct of an $C_8$-$C_{32}$ alcohol having 1 to 20 mole number of alkylene oxide.

The aliphatic dibasic acid mentioned above should preferably be a compound represented by the following formula (4):

[Formula 4]

$$HOOC—(CH_2)_q—(CHR^4)_r—COOH \quad (4)$$

where $R^4$ is a hydrogen atom, alkyl group, or alkenyl group; q is an integer ranging from 0 to 9; and r is 0 or 1.

The polyether compound should preferably be a polyalkylene glycol copolymer, which is a copolymer of ethylene oxide (EO) and propylene oxide (PO). The molar ratio of EO/PO should preferably range from 80:20 to 10:90, and the average molecular weight of the copolymer should preferably range from 200 to 20000.

The finish should preferably contain a component (D), a modified silicone, constituting 0.05 to 5 wt % of the finish. The modified silicone as the component (D) should preferably be a compound represented by the following formula (5):

[Formula 5]

(5)

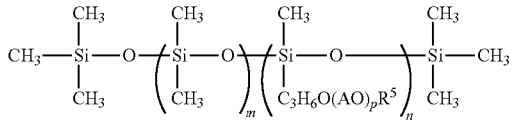

where $R^5$ is a hydrogen atom, alkyl group, or alkenyl group; A is a $C_2$-$C_4$ alkylene group; m and n are integers that satisfy the expression, m+n=1 to 30; and p is an integer ranging from 3 to 35.

The synthetic filament yarn should preferably comprises polyester fiber, polyamide fiber or polypropylene fiber.

The finish-application emulsion of the present invention is prepared by dispersing a finish for friction false-twist texturing in water to make an oil-in-water emulsion.

The synthetic filament yarn of the present invention is applied with the finish for friction false-twist texturing in an amount of 0.1 to 5.0 wt % of the yarn weight.

The manufacturing process for the synthetic filament yarn of the present invention includes a step of applying the finish for friction false-twist texturing or the finish-application emulsion to filament yarn.

The resultant yarn of the present invention is manufactured by heating, drawing, and false-twist texturing the aforementioned synthetic filament yarn and/or a synthetic filament yarn produced in the aforementioned manufacturing process.

ADVANTAGEOUS EFFECTS

The finish for synthetic filament yarn processed in friction false-twist texturing of the present invention imparts improved extreme-pressure lubricity to synthetic filament yarn subjected to false-twist texturing so as to prevent damage on yarn in a heating zone, especially the damage on yarn in high-speed drawing and false-twist texturing or the damage on synthetic filament yarn of low monofilament tenacity. Consequently the finish of the present invention minimizes broken filaments and ends down in false-twist texturing with a contact type false-twist texturing machine or a non-contact type false-twist texturing machine. In addition, the finish prevents stain on heater surface, especially the stain on heater surface of a contact type false-twist texturing machine, to extend heater cleaning intervals.

BEST MODE FOR CARRYING OUT THE INVENTION

The present invention provides a finish for synthetic filament yarn processed in friction false-twist texturing, which comprises 30 to 98 wt % of a polyether compound and essentially comprises the components (A) and (B) in a specified amount respectively. The component (A) is at least one member selected from the group consisting of (A1) a $C_1$-$C_{10}$ fatty acid, (A2) $C_1$-$C_{10}$ hydroxyfatty acid, (A3) a sarcosine derivative, and their salts, and the component (B) is an alkyl phosphate salt. The finish is described in detail below.

The component (A) employed for the present invention is at least one member selected from the group consisting of (A1) a $C_1$-$C_{10}$ fatty acid, (A2) $C_1$-$C_{10}$ hydroxyfatty acid, (A3) a sarcosine derivative, and their salts. The component (A)

exerts an effect in combination with other essential components of the present invention to decrease the viscosity of a finish being decomposed (turning into tar) on a contact type heater and prevent the finish from solidification. The components (A1), (A2), (A3), and their salts may be employed alone as the component (A), or at least two of them may be employed as the component (A). The ratio of the component (A) in the finish should range from 0.05 to 5 wt %, preferably from 0.1 to 3 wt %, and more preferably from 0.2 to 2 wt %. A ratio of the component (A) lower than 0.05 wt % cannot sufficiently decrease the viscosity of a finish being decomposed (turning into tar). On the other hand, a ratio of the component (A) higher than 5 wt % increases finish residue after heating a finish for a long time and leads to seriously increased stain on contact type heaters.

The component (A1) may be a $C_1$-$C_{10}$ fatty acid, precisely a monocarboxylic acid having a $C_1$-$C_9$ hydrocarbon group and a carboxyl group, which is not specifically restricted and may include saturated and unsaturated fatty acids, and the hydrocarbon group may be linear or branched. A compound represented by the formula (1) is preferable among those compounds.

In the formula (1), "$R^1$" is a hydrogen atom or a methyl group, and "l" is preferably an integer ranging from 0 to 8, preferably from 1 to 4, further more preferably from 1 to 3, for good compatibility of the component (A1) with other finish components and no adverse effect on the lubricity of the resultant finish. If "l" is greater than 8, the component (A1) will be incompatible with other finish components and solidify in decomposed finish (finish turning into tar) to sometimes damage yarn with the solid.

The examples of the component (A1) include formic acid, acetic acid, propionic acid, butyric acid, valeric acid, hexanoic acid, heptanoic acid, octanoic acid, and pelargonic acid. Among those acids, butyric acid and acetic acid are preferable, and acetic acid is more preferable.

The component (A2) may be a $C_1$-$C_{10}$ hydroxyfatty acid, precisely a monocarboxylic acid having a $C_1$-$C_9$ hydrocarbon group, a hydroxy group, and a carboxyl group, which is not specifically restricted and may include saturated and unsaturated hydroxyfatty acids. The hydrocarbon group may be linear or branched. The position of the hydroxy group added to the hydrocarbon group is not specifically restricted. Among those compounds, a compound represented by the formula (2) is preferable.

In the formula (2), "$R^2$" is a hydrogen atom, $C_1$-$C_8$ alkyl group, or $C_1$-$C_8$ alkenyl group, and a $C_1$-$C_8$ alkyl group or $C_1$-$C_8$ alkenyl group is preferable for preventing possible decomposition and evaporation of the component (A2) which occur before the component exerts its effect. The carbon number of "$R^2$" should preferably range from 1 to 6, more preferably from 1 to 4. If "$R^2$" has a carbon number greater than 8, the component (A2) will be incompatible with other finish components and solidify in decomposed finish (finish turning into tar) to sometimes damage yarn with the solid. The alkyl group is more preferable for "$R^2$".

The examples of the component (A2) include hydroxypropionic acids, such as lactic acid (2-hydroxypropionic acid) and beta-lactic acid (3-hydroxypropionic acid); and hydroxybutyric acids, such as 2-hydroxybutyric acid, 3-hydroxybutyric acid, and 4-hydroxybutyric acid. Among those acids, lactic acid and 2-hydroxybutyric acid, which attain good compatibility of the component (A2) with other finish components and effectively decrease the viscosity of decomposed finish (finish turning into tar) without increasing the amount of decomposed finish residue, are preferable, and lactic acid is more preferable.

The component (A3) may be a sarcosine derivative which is not specifically restricted. The sarcosine derivative includes an alpha-amino acid which has a carbon atom being bonded with a carboxyl group and also bonded with a secondary or tertiary amino group having a methyl group, and also includes an aliphatic amino acid having a main chain of N-methylglycine or N-methylglycine. Among those sarcosine derivatives, the compound represented by the formula (3) is preferable.

In the formula (3), "$R^3$" is a hydrogen atom, $C_1$-$C_{34}$ alkyl group, $C_1$-$C_{34}$ alkenyl group, or $C_1$-$C_{34}$ acyl group. The acyl group is represented as (R—CO—), which is formed by removing a hydroxy group (OH) from a carboxylic acid, where "R" may be an alkyl group or alkenyl group. "$R^3$" should preferably be a $C_1$-$C_{34}$ alkyl group, $C_1$-$C_{34}$ alkenyl group, or $C_1$-$C_{34}$ acyl group for preventing possible decomposition and evaporation of the component (A3) which occur before the component exerts its effect. The carbon number of "$R^3$" should preferably range from 4 to 24, more preferably from 6 to 20. If "$R^3$" has a carbon number greater than 34, the resultant finish will sometimes leave high amount of residue to increase stain on heater surface. The alkenyl group and acyl group are more preferable for "$R^3$".

The examples of the component (A3) include sarcosine, N-lauryl sarcosine, N-oleyl sarcosine, N-lauroyl sarcosine, N-oleoyl sarcosine, N-myristoyl sarcosine, N-palmitoyl sarcosine, N-stearoyl sarcosine, undecanoly sarcosine, tridecanoyl sarcosine, and pentadecanoyl sarcosine. Among those sarcosines, sarcosine, N-lauryl sarcosine, and N-oleyl sarcosine, which attain good compatibility of the component (A3) with other finish components and effectively decrease the viscosity of decomposed finish (finish turning into tar) without increasing the amount of decomposed finish residue, are preferable, and N-lauryl sarcosine and N-oleyl sarcosine are more preferable.

The component (A) should preferably be a salt of at least one component selected from the group consisting of the components (A1), (A2), and (A3), and a metal salt or amine salt is preferable. The examples of the metal salt include alkali metal salts and alkaline earth metal salts, and alkali metal salts are preferable. Among the alkali metal salts, sodium salts and potassium salts are more preferable. The examples of the amine salt include alkylamine salts, alkanolamine salts, ammonium salts, and POE alkylaminoether salts. Among those, alkanolamine salts and POE alkylaminoether salts are preferable, and POE lauryl aminoether salt, dibutylethanolamine salt, and triethanolamine salt are more preferable.

The component (A1), a salt of the component (A1), the component (A2), a salt of the component (A2), the component (A3), a salt of the component (A3), and the combination thereof may be employed as the component (A). Among those components, the component (A1) and/or a salt of the component (A1), and the component (A2) and/or a salt of the component (A2) are preferable for their property not to adversely affect on the lubricity of the resultant finish. Furthermore, the component (A2) and/or a salt of the component (A2) is more preferable because of their good effect to decrease the viscosity of decomposed finish (finish turning into tar).

The alkyl phosphate salt employed as the component (B) of the present invention is a salt of the monoester or diester of phosphoric acid and an alcohol or an alkylene oxide adduct of an alcohol. The component (B), in combination with other essential components of the present invention, improves the extreme-pressure lubricity of the resultant finish so as to prevent yarn damage in heating zone, especially the damage on yarn in high-speed drawing and false-twist texturing or the damage on synthetic filament yarn of low monofilament tenacity. One of or a combination of at least two of the alkyl phosphate salts belonging to the component (B) may be employed. The ratio of the component (B) in a finish should range from 0.01 to 3 wt %, preferably from 0.1 to 2 wt %, and more preferably from 0.2 to 1 wt %. A ratio of the component (B) lower than 0.01 wt % cannot sufficiently exert the effect of lessening the heat transferred from a heater to finish on yarn and improving the extreme-pressure lubricity on yarn so as to prevent yarn damage in heating zone. On the other hand, a ratio greater than 3 wt % will leave high amount of finish residue to increase stain on heater surface.

A preferable alkyl phosphate salt to be employed as the component (B) is a phosphate salt of a $C_8$-$C_{32}$ alcohol or a phosphate salt of an alkylene oxide adduct of the alcohol having 1 to 20 moles of alkylene oxide per 1 mole of the alcohol. A $C_8$-$C_{32}$ alcohol is a compound having a $C_8$-$C_{32}$ alkyl group and hydroxy group wherein the alkyl group may either be linear or branched and either be primary, secondary or tertiary. Among those alcohols, a $C_4$-$C_{24}$ alcohol is preferable, and a $C_6$-$C_{22}$ alcohol is further preferable.

The alkylene oxide adduct of the alcohol mentioned above is produced by bonding 1 mole of the alcohol with 1 to 20 moles of alkylene oxide in addition reaction. The examples of the alkylene oxide include ethylene oxide, propylene oxide, and butylene oxide. One of or a combination of at least two of the alkylene oxides may be employed. The mole number of the alkylene oxide to be added to the alcohol preferably ranges from 1 to 20, more preferably from 2 to 18, and further more preferably from 3 to 16. A mole number of the alkylene oxide greater than 20 will deteriorate the compatibility of the component (B) with other finish components.

The phosphate salt is the salt of a monoester and/or diester which is produced by reacting phosphoric acid and the alcohol or by reacting phosphoric acid and an alkylene oxide adduct of the alcohol, and may optionally contain triester. The phosphate salt may be a metal salt or amine salt of the phosphate esters mentioned above, and preferable metal salts include alkali metal salts and alkaline earth metal salts. Among those metal salts, alkali metal salts are preferable, and sodium salt and potassium salt are more preferable. The examples of the amine salt include alkylamine salts, alkanolamine salts, ammonium salts, and POE alkylaminoether salts. Among those salts, alkanolamine salts and POE alkylaminoether salts are preferable, and dibutylethanolamine salt, triethanolamine salt, and POE lauryl aminoether salt are more preferable.

The examples of a phosphate compound employed for the component (B) include (1) alkyl phosphate salts, such as butyl phosphate, hexyl phosphate, octyl phosphate, 2-ethylhexyl phosphate, decyl phosphate, lauryl phosphate, tridecyl phosphate, myristyl phosphate, stearyl phosphate, oleyl phosphate, and behenyl phosphate; and (2) (poly)oxyalkylene alkyl phosphate salts, such as (poly)oxyalkylene butyl phosphate, (poly)oxyalkylene hexyl phosphate, (poly)oxyalkylene octyl phosphate, (poly)oxyalkylene 2-ethylhexyl phosphate, (poly)oxyalkylene decyl phosphate, (poly)oxyalkylene lauryl phosphate, (poly)oxyalkylene tridecyl phosphate, (poly)oxyalkylene myristyl phosphate, (poly)oxyalkylene stearyl phosphate, (poly)oxyalkylene oleyl phosphate, and (poly)oxyalkylene behenyl phosphate. These alkyl phosphates and (poly)oxyalkylene alkyl phosphates include monoester salts, diester salts, polyester salts, and mixtures thereof. Among those ester salts, POE(3) potassium $C_{12}$-$C_{14}$ alkyl phosphate and potassium $C_{11}$-$C_{15}$ alkyl phosphate are preferable, and potassium $C_{11}$-$C_{15}$ alkyl phosphate is more preferable.

The polyether compound employed for the present invention is a polyoxyalkylene glycol polymer, which imparts excellent lubricity and cohesiveness to filament and is highly emulsifiable, and is produced in a known method. One of or a combination of at least two of the polyether compounds may be used. The ratio of the polyether compound in the finish should range from 30 to 98 wt %, preferably from 35 to 95 wt %, more preferably from 40 to 90 wt %, and furthermore preferably from 45 to 85 wt %. A ratio of the polyether compound lower than 30 wt % cannot impart sufficient cohesiveness to filament, while a ratio greater than 98 wt % increases the viscosity of the resultant finish to inhibit uniform finish application on filament yarn.

The polyether compound should preferably be a polyalkylene glycol copolymer comprising a copolymer of ethylene oxide (EO) and propylene oxide (PO) with a EO/PO molar ratio ranging from 80:20 to 10:90 and an average molecular weight ranging from 200 to 20,000. The polyalkylene glycol copolymer may be a random or block EO/PO copolymer, and one of or both ends of the copolymer may be capped with a mono- or polyhydric alcohol or mono- or polybasic acid which forms an ether or ester bond at the ends of the copolymer. Such polyalkylene glycol copolymer can be produced by copolymerizing EO and PO in an known method.

The EO/PO molar ratio should preferably range from 75:25 to 10:90. A EO/PO molar ratio greater than 80:20 may result in poor compatibility of the polyalkylene glycol copolymer with other finish components, while a EO/PO molar ratio smaller than 10:90 may impart insufficient cohesiveness to filament yarn. The preferable average molecular weight of the polyalkylene glycol copolymer ranges from 800 to 12,000, more preferably from 1,000 to 8,000. An average molecular weight smaller than 200 may impart insufficient cohesiveness to filament yarn, while an average molecular weight greater than 20,000 may result in poor compatibility of the polyalkylene glycol copolymer with other finish components and increases the viscosity of the resultant finish to inhibit uniform finish application on filament yarn. The average molecular weight of the polyalkylene glycol copolymer was determined with gel permeation chromatography (GPC).

The finish for synthetic filament yarn processed in friction false-twist texturing of the present invention should preferably contain a component (C), an aliphatic dibasic acid and/or its salt, in addition to the polyether compound mentioned above, the component (A), and the component (B). The component (C) has an excellent performance to decrease the viscosity of decomposed finish (finish turning into tar) and prevent the solidification of the finish. The component (C), in combination with other essential finish components of the present invention, more effectively prevents yarn damage due to decomposed finish (finish turning into tar) and decreases broken filaments and ends down. One of or a combination of at least two of those included in the component (C), an aliphatic dibasic acid and/or its salt, may be used. An aliphatic dibasic acid is preferable for the component (C).

The ratio of the component (C) in a finish should preferably range from 0.01 to 3 wt %, more preferably from 0.1 to 2 wt %, and further more preferably from 0.2 to 1 wt %. A ratio of the component (C) smaller than 0.01 wt % may not sufficiently decrease the viscosity of decomposed finish (finish turning into tar), while a ratio greater than 3 wt % may increase finish residue after heating so as to increase stain on heater surface. The aliphatic dibasic acid is not specifically restricted so far as it is a compound having an aliphatic hydrocarbon group and two carboxyl groups in its molecule, and a compound represented by the formula (4) is preferable.

In the formula (4), $R^4$ is a hydrogen atom, an alkyl group, or an alkenyl group. The alkyl group and alkenyl group preferably have a carbon number ranging from 4 to 34, more preferably from 6 to 26. Among those, $C_8$-$C_{22}$ alkenyl group is preferable for $R^4$ because the resultant component has good compatibility with other finish components. In the formula (4), "q" is an integer ranging from 0 to 9, preferably from 1 to 8, and "r" is 0 or 1.

The examples of the aliphatic dibasic acid include succinic acid, oxalic acid, malonic acid, glutaric acid, adipic acid, pimelic acid, sebacic acid, maleic acid, fumaric acid, and their derivatives. Among those compounds, succinic acid, malonic acid, adipic acid, and their derivatives are preferable, and succinic acid and its derivatives are more preferable.

The examples of the salt of the aliphatic dibasic acid include the metal salts and amine salts of the aliphatic dibasic acids mentioned above. Preferable metal salts are alkali metal salts and alkaline earth metal salts of the aliphatic dibasic acids, and the alkali metal salts are more preferable. Among those, sodium salts and potassium salts are further more preferable. Preferable amine salts are alkylamine salts, alkanolamine salts, ammonium salts, and POE alkyl aminoether salts of the aliphatic dibasic acids, and alkanolamine salts and POE alkyl aminoether salts are more preferable. Among those, dibutylethanol amine salt, triethanol amine salt, and POE lauryl aminoether salt are further more preferable.

For applying to a filament yarn to be processed with a contact type false-twist texturing machine, the finish for synthetic filament yarn processed in friction false-twist texturing of the present invention should preferably contain the component (D), the modified silicone, in addition to the polyether compound mentioned above, the component (A), and the component (B).

The modified silicone employed as the component (D) of the present invention is a polyorganosiloxane having an organic group on its side chain or end. The component (D), in combination with other essential finish components of the present invention, more effectively lessens the heat transferred from a heater to finish on yarn in texturing. One of or a combination of at least two of such modified silicones may be used. The ratio of the component (D) should range from 0.05 to 5 wt %, preferably from 0.2 to 2 wt %, and more preferably from 0.3 to 1 wt %. A ratio of the component (D) smaller than 0.05 wt % cannot sufficiently lessen the heat transferred from a heater to finish on yarn, while a ratio greater than 5 wt % result in high amount of finish residue to seriously increase stain on heater surface.

The examples of the modified silicone include alkyl-modified silicones, ester-modified silicones, polyether-modified silicones, amide-modified silicones, amino-modified silicones, carbinol-modified silicones, carboxy-modified silicones, mercapto-modified silicones, phosphorus acid-modified silicones, epoxy-modified silicones, MQ silicone resin, MQT silicone resin, and T silicone resin. Among those, polyether-modified silicones are preferable, and they should preferably be those represented by the formula (5).

In the formula (5), $R^5$ is a hydrogen atom, an alkyl group, or an alkenyl group. The alkyl group and the alkenyl group should preferably have a carbon number ranging from 1 to 34. "A" in the formula (5) is a $C_2$-$C_4$ alkylene group, and the oxyalkylene group (AO) may be one or at least two variants of oxyalkylene groups. The mole number of the oxyalkylene group, "p", is preferably an integer ranging from 3 to 35, more preferably from 5 to 30. A polyether-modified silicone with the mole number smaller than 3 may be thermally decomposed not to exert its effect. On the other hand, a polyether-modified silicone with the mole number greater than 35 may be incompatible with other finish components and fail to exert its effect sufficiently. The letters, "m" and "n", are the integers that satisfy the expression, m+n=a value in the range of 1 to 30, and should preferably range from 3 to 27, more preferably from 5 to 25. The sum of "m" and "n" lower than 1 may result in thermal decomposition of the resultant polyether-modified silicone so that the silicone fails to exert its effect. On the other hand, the sum of "m" and "n" greater than 30 may increase the thermal residue of the resultant finish so as to seriously increase stain on heater surface in texturing.

For applying to a filament yarn to be processed with a non-contact type false-twist texturing machine, it is preferable that the finish for synthetic filament yarn processed in friction false-twist texturing of the present invention does not substantially contain a silicone compound. Specifically, a silicone compound in the finish should preferably be lower than 0.05 wt %, more preferably 0 wt %.

The finish for friction false-twist texturing of the present invention should preferably leave at least 5 wt % of residue after heating at 220 deg. C. for 5 hours and at most 3 wt % of residue after heating at 220 deg. C. for 15 hours. A finish leaving at least 5 wt % of residue after heating at 220 deg. C. for 5 hours prevents yarn damage caused by the solidification of a finish between yarn and heater surface, and the residue is flowable enough at the early stage of heating (for 5 hours) to be taken away by running yarn so as to retard the deposition of the finish on heater surface. A finish leaving at most 3 wt % of residue after heating at 220 deg. C. for 15 hours is effective to prevent the adhesion and deposition of a finish thrown off from yarn onto heater surface so as to avoid the disturbance of yarn running due to the finish adhering and depositing on heater surface.

A preferable yarn-to-smooth-chrome-pin static frictional coefficient (the coefficient determined in the method mentioned later) attained by the finish for friction false-twist texturing of the present invention should preferably range from 0.20 to 1.50, more preferably from 0.20 to 1.40, further more preferably from 0.20 to 1.35, after heating the finish-applied yarn at 210 deg. C. The yarn-to-smooth-chrome-pin static frictional coefficient controlled within the range from 0.20 to 1.50 after heating the finish-applied yarn at 210 deg. C. is effective to prevent yarn damage in heating zone, especially effective to prevent yarn damage in high-speed drawing and false-twist texturing or yarn damage in drawing and false-twist texturing synthetic filament yarn of low monofilament tenacity. A yarn-to-smooth-chrome-pin static frictional coefficient lower than 0.20 may result in yarn slipping on heater or cooling plate surface to lead to inconstant yarn tension in false-twisting. On the other hand, a yarn-to-smooth-chrome-pin static frictional coefficient higher than 1.50 may result in insufficient finish film strength on yarn surface so as to increase broken filaments and ends down.

The finish for friction false-twist texturing of the present invention may contain at least one of known emulsifiers, penetrants, and stabilizers including polyoxyethylene (hereinafter referred to as POE) alkyl ether, polyethylene glycol (hereinafter referred to as PEG) ester, and POE alkylphenyl ether. The examples of the stabilizers include water, ethylene glycol, and propylene glycol. The amount of the stabilizers is not specifically restricted, and preferably ranges from 0.5 to 30 wt %, more preferably from 1 to 20 wt %.

The finish for friction false-twist texturing of the present invention may also contain a lubricant, such as a fatty acid ester, so far as the effect of the present invention is not deteriorated. The examples of the fatty acid ester include esters of a monohydric alcohol and a monocarboxylic acid (such as methyl oleate, butyl stearate, isooctyl palmitate, isooctyl stearate, isooctyl oleate, lauryl oleate, isotridecyl stearate, hexadecyl stearate, isostearyl oleate, oleyl laurate, and oleyl oleate); esters of a polyhydric alcohol and a monocarboxylic acid (such as diethylene glycol dioleate, hexamethylene glycol dioleate, neopentyl glycol dilaurate, trimethylolpropane tricaprylate, glycerin trioleate, pentaerythritol tetraoleate, bisphenol A dilaurate, and thiodipropanol dilaurate; esters of a polycarboxylic acid and a monohydric alcohol (such as dioleyl maleate, diisotridecyl adipate, dioleyl adipate, dioctyl sebacate, dioctyl azelate, dioctyl phthalate, and triacryl trimellitate); esters of an alcohol/alkylene oxide adduct and a carboxylic acid (such as the ester of POE (2) NEODOL 23 (a synthetic alcohol manufactured by Shell) and lauric acid, the ester of POP (2) isotridecyl alcohol and lauric acid, and the diester of POE (2) NEODOL 23 and adipic acid); alkylene oxide copolymers and their derivatives (such as block or random copolymers of ethylene oxide and propylene oxide, and copolymers produced by capping one or both ends of the block or random copolymers with an alcohol or carboxylic acid); and thio-ethers of a thiobisphenol derivatives or long chain hydrocarbons. Two or more of those lubricants may optionally be employed. The amount of the lubricants in a finish is not specifically restricted, and preferably ranges from 1 to 50 wt %, more preferably from 2 to 30 wt %.

The finish of the present invention may also contain a surfactant or antioxidant for the purpose of emulsifying the finish in water, optionally removing the finish from yarn with water after texturing, or facilitating finish adhesion on yarn surface, so far as the effect of the present invention is not deteriorated. The surfactant may also be employed for imparting antistaticity or cohesiveness to yarn. A surfactant having lubricating performance may also be employed. The examples of such surfactant include nonionic surfactants (such as polyoxyethylene lauryl ether, polyoxyethylene oleyl ether, polyoxyethylene nonylphenyl ether, polyoxyethylene lauryl aminoether, polyethylene glycol monolaurate, polyethylene glycol dilaurate, polyethylene glycol monooleate, polyethylene glycol dioleate, glycerin monooleate, sorbitan monooleate, polyoxyethylene glycerin monolaurate, polyoxyethylene sorbitan trioleate, polyoxyethylene castor oil ether, and polyoxyethylene hydrogenated castor oil ether); and known anionic surfactants such as alkyl sulfonate salt. The examples of the antioxidant include phenolic antioxidants, sulfur-containing antioxidants, and phosphite antioxidants which are known to those skilled in the art. One of or a plurality of those surfactants and antioxidants may be used. The amount of the surfactants and antioxidants in a finish is not specifically restricted, and the sum of the surfactants and antioxidants should preferably range from 0.1 to 50 wt %, more preferably from 0.1 to 30 wt %.

The method of producing the finish for friction false-twist texturing of the present invention is not specifically restricted, and a known method may be employed. The finish for friction false-twist texturing may be produced by blending the above-mentioned components in any order. The finish for friction false-twist texturing of the present invention should preferably be applied to filament yarn with kiss-roll or metering-guide finish application devices from an oil-in-water emulsion prepared by dispersing the finish in water.

An oil-in-water finish emulsion for finish application should contain a finish in an amount preferably from 4 to 30 wt %, more preferably from 6 to 20 wt %. The method for preparing a finish application emulsion is not specifically restricted, and may be prepared in a known method.

The finish for friction false-twist texturing of the present invention is especially suitable for synthetic filament yarns, such as polyester filament, polyamide filament, and polypropylene filament, which are processed in false-twist texturing. Polyesters comprising filament yarn include polyester (PET) comprising ethylene terephthalate as a major constituent unit, polyester (PTT) comprising tri-methylene-ethylene terephthalate as a major constituent unit, polyester (PBT) comprising butylene-ethylene terephthalate as a major constituent unit, and polyester (PLA) comprising lactic acid as a major constituent unit. Polyamides comprising filament yarn include nylon 6 and nylon 66, and polypropylenes comprising filament yarn include polypropylene.

The process for applying the finish for friction false-twist texturing of the present invention to synthetic filament yarn and the process for false-twist texturing the finish-applied synthetic filament yarn are explained in the following description.

The finish for friction false-twist texturing of the present invention should be applied to as-spun synthetic filament yarn in spinning process with kiss-roll or metering-guide finish application devices from an oil-in-water emulsion prepared by dispersing the finish in water. The finish may be applied to filament yarn in neat state or from dilution with a low-viscosity mineral oil. The amount of the finish for friction false-twist texturing applied to synthetic filament yarn preferably ranges from 0.1 to 5 wt % of yarn weight, more preferably from 0.2 to 2 wt %, further more preferably from 0.25 to 1.5 wt %. An amount lower than 0.1 wt % may incompletely coat filament to cause broken filaments and ends down. On the other hand, an amount higher than 5 wt % may increase the amount of finish thrown off from yarn onto heater surface to seriously increase stain on heater surface.

The synthetic filament yarn applied with the finish for friction false-twist texturing of the present invention is heated, drawn, and false-twisted throughout the course between a first feed roller positioned just before a first heater (including a contact type heater to directly heat synthetic filament yarn being contacted to the heater, and a non-contact type heater to heat synthetic filament yarn with radiation heat from a high temperature heater) and a second feed roller positioned just after a false-twisting device (including devices for pin-spindle false-twisting method and friction false-twisting method with discs or belts), cooled down on a cooling plate, applied with 0.3 to 5.0 wt % of an after oil (or corning oil), and taken up into a package of false-twist textured yarn. The false-twisting device is positioned just after the cooling plate and functions to false-twist the yarn. The false-twisted yarn may sometimes be heat-set on a second heater.

Broken filaments and ends down are caused by monofilament breakage which is resulted from high speed drawing and false-twisting of filament yarn passing through a first heating unit (especially above a non-contact-type heater) or drawing and false-twisting of filament yarn of low monofilament tenacity. In a texturing process with a contact-type heater, broken filaments and ends down are caused from thermally damaged yarn due to a finish of poor heat resistance or from damaged yarn due to a finish thrown off from yarn onto heater surface to be decomposed (turning into tar). A finish decomposed (turning into tar) on a first heater inhibits constant yarn running to result in yarn swinging. The inconstant yarn running or yarn swinging may also be the causes of broken filaments and ends down.

The finish for friction false-twist texturing of the present invention exhibits excellent lubricity under extreme pressure, and prevents monofilament breakage caused by high-speed drawing and false-twisting. The finish has excellent heat resistance to avoid its decomposition (turning into tar) so as to prevent broken filaments and ends down in false-twist texturing with special yarns or in high-speed false-twist texturing, which are increasing recently. The finish also prevents stain on heater surface so as to extend heater-cleaning intervals.

EXAMPLE

The present invention is described specifically with the following Examples and Comparative examples, though the present invention is not restricted within the scope of those examples. The "%" in the description and tables means "wt % (weight percent)". The properties and performances mentioned in the Examples and Comparative examples were determined in the following methods.

[Ends Down Frequency]

A multifilament yarn sample was processed continuously for 10 days on a predetermined spindle of a draw-texturing machine with resetting the yarn on the spindle after ends down. Ends down frequency per one hour in the operation was calculated and evaluated according to the following criteria.

High: 20 times or more

Medium: 11 to 19 times

Low: 10 times or less

[Stain on Contact-Type Heater]

Stain on heater surface after the texturing operation for 10 days mentioned above was visually inspected, and categorized as follows.

O: little stain on heater surface

Δ: stain on heater surface which is removable with wet gauze x: serious stain on heater surface which cannot be removed with wet gauze

[Heat Resistance of Finish for Friction False-Twisting: Flowability of Finish at the Initial Stage of Heating]

About 1 g of a finish was weighed in a stainless dish of 6 cm in diameter, and heated at 220 deg. C. in a Geer oven for 5 hours to simulate the initial stage of heating. After the heating, the hardness of the thermal residue on the stainless dish was inspected tactually and evaluated. The hardness of the thermal residue correlates to the hardness of the finish thrown off from yarn onto contact-type heater surface in draw-texturing operation. A finish keeping its softness after being thrown onto contact-type heater surface contributes to preventing the breakage of monofilaments being drawn on the heater surface so as to minimize ends down in false-twist texturing. On the other hand, a finish leaving hard residue on heater surface results in increased ends down and broken filaments in false-twist texturing. Furthermore the hard residue stains on heater surface and shortens heater-cleaning intervals.

O: soft finish residue, in which an inserted needle is moved easily

Δ: slightly hard residue, in which an inserted needle is moved with some resistance x: hard residue, in which a needle cannot be inserted

[Heat Resistance of Finish for Friction False-Twisting: Finish Residue after Heating]

Following to the 5-hour heating mentioned above, the residue in the stainless dish was further heated at the same temperature for 15 hours to obtain final residue. The residue was then weighed and calculated into percentage of the initial amount of the finish by the following expression (1). The amount of the final residue correlates to the amount of "tar" resulted from finish spreading out of yarn path and decomposing. Smaller amount of final residue results in longer intervals for heater cleaning.

$$\text{Amount of residue}(\%)=\text{Amount of finish after heating/amount of finish before heating}\times 100 \quad (1)$$

[Yarn-To-Smooth Pin Static Frictional Coefficient]

A semi-dull polyester multifilament yarn (167T/48f, a standard yarn) was deoiled and applied with each of the finishes in Examples and Comparative examples in an amount (OPU) of 0.4 wt % of yarn weight. The standard yarn and the finish-applied yarns were tested with a yarn friction meter (YF-850, manufactured by Toray Engineering Co., Ltd.) to measure the tension of those yarns, and the result was calculated into yarn-to-smooth pin static frictional coefficient by the following formula (2):

$$\text{Yarn-to-smooth-chrome-pin static frictional coefficient}=4.5/\pi\times \ln(T_2/T_1) \quad (2)$$

where $T_1$ is the tension of the standard yarn (167T/48f) before deoiling, and $T_2$ is the tension of each of the yarn samples applied with the finishes for the testing.

Testing Condition

Yarn speed: 0.5 m/min

Heater roller temperature: 210 deg. C.

Loading: 15 g

Friction pin: smooth chrome pin

Examples 1 to 18 and Comparative Examples 1 to 5

The finish components for Example 1 shown in Table 1 were blended to be formulated into the finish for friction false-twist texturing in Example 1. The finish is made into a finish emulsion containing 10 wt % of the finish in which the finish is dispersed in water to form an oil-in-water emulsion.

The finish emulsion was applied with a metering-pump finish application device to as-spun full-dull polyester multifilament yarn, which was spun at a spinning speed of 3000 m/min, in 0.6 wt % of the yarn weight, and the yarn was taken up into a package of finish-applied filament yarn (POY of 89T/72f). The filament yarn was drawn and false-twist textured with a draw-texturing machine equipped with a contact-type heater for 10 days. Ends down frequency and stain on heater surface in the draw-texturing operation were determined in the methods mentioned above. The heat resistance of the formulated finish was tested in the method mentioned above. The result of those tests are shown in Table 1.

The finishes in Examples 2 to 18 and Comparative examples 1 to 5 were formulated and tested in the same manner as in Example 1 except that the finish components for each finish shown in Tables 1 to 3 were employed instead of the components for Example 1. The results are shown in Tables 1 to 3.

Testing Condition for the Draw-Texturing Machine Equipped with a Contact-Type Heater Draw-texturing speed: 600 m/min Draw ratio: 1.60

False-twisting method: urethane-disc false-twisting

Disc arrangement: 1-5-1 (guide disc-working discs-guide disc)

Disc-to-yarn speed ratio: 1.8

First heater temperature: 190 deg. C.

Second heater temperature: room temperature

TABLE 1

| | | | Example | | | | | | | | |
|---|---|---|---|---|---|---|---|---|---|---|---|
| | | | 1 | 2 | 3 | 4 | 5 | 6 | 7 | 8 | 9 |
| Finish component | Polyether compound | EO-PO compound (1) | 68 | 63 | 48 | 48 | 58 | 58 | 68 | 68 | 68 |
| | | EO-PO compound (2) | 10 | 10 | 10 | 10 | 10 | 10 | 10 | 10 | 10 |
| | | EO-PO compound (3) | 10 | 10 | 10 | 10 | 10 | 10 | 10 | 10 | 10 |
| | Component (A) | Potassium lactate | 0.5 | 0.5 | 0.5 | 0.5 | 0.5 | 0.5 | | | |
| | | Potassium acetate | | | | | | | 0.5 | | |
| | | Potassium pelargonate | | | | | | | | 0.5 | |
| | | Potassium oleoyl sarcosinate | | | | | | | | | 0.5 |
| | Component (B) | Potassium $C_{12}$-$C_{14}$ alkyl phosphate | 0.5 | 0.5 | 0.5 | | 0.5 | 0.5 | 0.5 | 0.5 | 0.5 |
| | | POE(3) potassium $C_{12}$-$C_{14}$ alkyl phosphate | | | | 0.5 | | | | | |
| | Component (C) | Potassium alkenyl succinate | 0.5 | 0.5 | 0.5 | 0.5 | 0.5 | 0.5 | 0.5 | 0.5 | 0.5 |
| | Component (D) | Modified silicone | 0.5 | 0.5 | 0.5 | 0.5 | 0.5 | 0.5 | 0.5 | 0.5 | 0.5 |
| | Others | 2-ethylhexyl laurate | | 5 | 20 | 20 | 10 | | | | |
| | | POE(8) $C_{12}$-$C_{14}$ alkyl $C_{10}$ etherester | | | | | | 10 | | | |
| | | POE(9) $C_{12}$-$C_{14}$ alkyl ether | 10 | 10 | 10 | 10 | 10 | 10 | 10 | 10 | 10 |
| Testing | Ends down frequency | | low | low | low | low | low | low | low | low | low |
| | Stain on contact heater | | ○ | ○ | ○ | ○ | ○ | ○ | ○ | ○ | ○ |
| | Finish flowability at initial stage of heating | | ○ | ○ | ○ | ○ | ○ | ○ | ○ | ○ | ○ |
| | Finish residue after heating (wt %) | | 1.2 | 1.4 | 1.6 | 1.5 | 1.3 | 1.3 | 1.2 | 1.3 | 1.0 |

TABLE 2

| | | | Example | | | | | | | | |
|---|---|---|---|---|---|---|---|---|---|---|---|
| | | | 10 | 11 | 12 | 13 | 14 | 15 | 16 | 17 | 18 |
| Finish component | Polyether compound | EO-PO compound (1) | 57.5 | 56.5 | 57.5 | 56.5 | 57.5 | 56.5 | 57.5 | 56.5 | 63.5 |
| | | EO-PO compound (2) | 10 | 10 | 10 | 10 | 10 | 10 | 10 | 10 | 10 |
| | | EO-PO compound (3) | 10 | 10 | 10 | 10 | 10 | 10 | 10 | 10 | 10 |
| | Component (A) | Potassium lactate | 1 | 2 | 0.5 | 0.5 | 0.5 | 0.5 | 0.5 | 0.5 | 0.5 |
| | | Potassium acetate | | | | | | | | | |
| | | Potassium pelargonate | | | | | | | | | |
| | | Potassium oleoyl sarcosinate | | | | | | | | | |
| | Component (B) | Potassium $C_{12}$-$C_{14}$ alkyl phosphate | 0.5 | 0.5 | 0.5 | 0.5 | 1 | 2 | 0.5 | 0.5 | 0.5 |
| | | POE(3) potassium $C_{12}$-$C_{14}$ alkyl phosphate | | | | | | | | | |
| | Component (C) | Potassium alkenyl succinate | 0.5 | 0.5 | 0.5 | 0.5 | 0.5 | 0.5 | 1 | 2 | |
| | Component (D) | Modified silicone | 0.5 | 0.5 | 1 | 2 | 0.5 | 0.5 | 0.5 | 0.5 | 0.5 |
| | Others | 2-ethylhexyl laurate | | | | | | | | | 5 |
| | | POE(8) $C_{12}$-$C_{14}$ alkyl $C_{10}$ etherester | 10 | 10 | 10 | 10 | 10 | 10 | 10 | 10 | |
| | | POE(9) $C_{12}$-$C_{14}$ alkyl ether | 10 | 10 | 10 | 10 | 10 | 10 | 10 | 10 | 10 |
| Testing | Ends down frequency | | low | low | low | low | low | low | low | low | medium |
| | Stain on contact heater | | ○ | ○ | ○ | ○ | ○ | ○ | ○ | ○ | Δ |
| | Finish flowability at initial stage of heating | | ○ | ○ | ○ | ○ | ○ | ○ | ○ | ○ | Δ |
| | Finish residue after heating (wt %) | | 1.5 | 2.1 | 1.8 | 1.9 | 1.3 | 1.6 | 1.6 | 1.9 | 2.9 |

TABLE 3

| | | | Comparative example | | | | |
|---|---|---|---|---|---|---|---|
| | | | 1 | 2 | 3 | 4 | 5 |
| Finish component | Polyether compound | EO-PO compound (1) | 64 | 64.5 | 63.5 | 63.5 | 58.5 |
| | | EO-PO compound (2) | 10 | 10 | 10 | 10 | 10 |
| | | EO-PO compound (3) | 10 | 10 | 10 | 10 | 10 |
| | Component (A) | Potassium lactate | | | | 0.5 | |
| | | Potassium acetate | | | | | |
| | | Potassium pelargonate | | | | | |
| | | Potassium oleoyl sarcosinate | | | | | |

TABLE 3-continued

| | | | Comparative example | | | | |
|---|---|---|---|---|---|---|---|
| | | | 1 | 2 | 3 | 4 | 5 |
| | Component (B) | Potassium $C_{12}$-$C_{14}$ alkyl phosphate | 0.5 | | 0.5 | | 0.5 |
| | | POE(3) potassium $C_{12}$-$C_{14}$ alkyl phosphate | | | | | |
| | Component (C) | Potassium alkenyl succinate | | | 0.5 | 0.5 | 0.5 |
| | Component (D) | Modified silicone | 0.5 | 0.5 | 0.5 | 0.5 | 0.5 |
| | Others | 2-ethylhexyl laurate | 5 | 5 | 5 | 5 | |
| | | POE(8) $C_{12}$-$C_{14}$ alkyl $C_{10}$ etherester | | | | | 10 |
| | | POE(9) $C_{12}$-$C_{14}$ alkyl ether | 10 | 10 | 10 | 10 | 10 |
| Testing | Ends down frequency | | high | high | high | high | high |
| | Stain on contact heater | | Δ | Δ | Δ | Δ | Δ |
| | Finish flowability at initial stage of heating | | X | X | X | X | X |
| | Finish residue after heating (wt %) | | 2.1 | 2.7 | 2.4 | 2.0 | 2.2 |

Examples 19 to 36 and Comparative Examples 6 to 11

The finish components for Example 19 shown in Table 4 were blended to be formulated into the finish for friction false-twist texturing in Example 19. The finish is made into a finish emulsion containing 10 wt % of the finish in which the finish is dispersed in water to form an oil-in-water emulsion.

The finish emulsion was applied with a metering-pump finish application device to as-spun semi-dull polyester multifilament yarn, which was spun with a spinning speed of 3000 m/min, to 0.4 wt % of the yarn weight, and the yarn was taken up into a package of finish-applied filament yarn (POY of 133T/36f). The filament yarn was drawn and false-twist textured with a draw-texturing machine equipped with a contact-type heater and a draw-texturing machine equipped with a non-contact-type heater respectively for 10 days. Ends down frequency in the draw-texturing operation with the texturing machines with a contact-type and non-contact-type heaters was tested in the methods mentioned above. The stain on the surface of the contact-type heater in the draw-texturing operation with the formulated finish, the flowability of the finish at the initial stage of heating, and the final residue of the finish after heating were tested in the methods mentioned above. The frictional property of the finish applied yarn (represented by yarn-to-smooth chrome pin frictional coefficient) in the draw-texturing with the non-contact heater was tested in the method mentioned above. The result of those tests are shown in Table 4.

The finishes in Examples 20 to 36 and Comparative examples 6 to 11 were formulated and tested in the same manner as in Example 19 except that the finish components for each finish shown in Tables 4 to 6 were employed instead of the components for Example 19. The results are shown in Tables 4 to 6.

Testing Condition for the Draw-Texturing Machine Equipped with a Contact-Type Heater Draw-texturing speed: 600 m/min Draw ratio: 1.60

False-twisting method: urethane-disc false-twisting

Disc arrangement: 1-5-1 (guide disc-working discs-guide disc)

Disc-to-yarn speed ratio: 1.8

First heater temperature: 200 deg. C.

Second heater temperature: room temperature

Testing Condition for the Draw-Texturing Machine Equipped with a Non-Contact-Type Heater Draw-texturing speed: 1100 m/min Draw ratio: 1.60

False-twisting method: urethane-disc false-twisting

Disc arrangement: 1-5-1 (guide disc-working discs-guide disc)

Disc-to-yarn speed ratio: 1.8

First heater temperature: 550 deg. C. for a short heater and 220 deg. C. for a long heater Second heater temperature: room temperature

TABLE 4

| | | | Example | | | | | | | | |
|---|---|---|---|---|---|---|---|---|---|---|---|
| | | | 19 | 20 | 21 | 22 | 23 | 24 | 25 | 26 | 27 |
| Finish component | polyether compound | EO-PO compound (1) | 68.5 | 63.5 | 48.5 | 48.5 | 58.5 | 58.5 | 68.5 | 68.5 | 68.5 |
| | | EO-PO compound (2) | 10 | 10 | 10 | 10 | 10 | 10 | 10 | 10 | 10 |
| | | EO-PO compound (3) | 10 | 10 | 10 | 10 | 10 | 10 | 10 | 10 | 10 |
| | Component (A) | Potassium lactate | 0.5 | 0.5 | 0.5 | 0.5 | 0.5 | 0.5 | | | |
| | | Potassium acetate | | | | | | | 0.5 | | |
| | | Potassium pelargonate | | | | | | | | 0.5 | |
| | | Potassium oleoyl sarcosinate | | | | | | | | | 0.5 |
| | Component (B) | Potassium $C_{12}$-$C_{14}$ alkyl phosphate | 0.5 | 0.5 | 0.5 | | 0.5 | 0.5 | 0.5 | 0.5 | 0.5 |
| | | POE(3) potassium $C_{12}$-$C_{14}$ alkyl phosphate | | | | 0.5 | | | | | |
| | Component (C) | Potassium alkenyl succinate | 0.5 | 0.5 | 0.5 | 0.5 | 0.5 | 0.5 | 0.5 | 0.5 | 0.5 |
| | Others | 2-ethylhexyl laurate | | 5 | 20 | 20 | 10 | | | | |
| | | POE(8) $C_{12}$-$C_{14}$ alkyl $C_{10}$ etherester | | | | | | 10 | | | |
| | | POE(9) $C_{12}$-$C_{14}$ alkyl ether | 10 | 10 | 10 | 10 | 10 | 10 | 10 | 10 | 10 |

TABLE 4-continued

| | | Example | | | | | | | | |
|---|---|---|---|---|---|---|---|---|---|---|
| | | 19 | 20 | 21 | 22 | 23 | 24 | 25 | 26 | 27 |
| Testing | Ends down frequency (contact heater) | medium | medium | medium | medium | medium | medium | medium | medium | medium |
| | Stain on contact heater | Δ | Δ | Δ | Δ | Δ | Δ | Δ | Δ | Δ |
| | Finish flowability at initial stage of heating | Δ | Δ | Δ | Δ | Δ | Δ | Δ | Δ | Δ |
| | Finish residue after heating (wt %) | 1.4 | 1.8 | 1.3 | 1.5 | 1.4 | 1.4 | 1.5 | 1.6 | 1.6 |
| | Ends down frequency (non-contact heater) | low | low | low | low | low | low | low | low | low |
| | Yarn-to-smooth chrome pin static frictional coefficient | 0.58 | 0.57 | 0.58 | 0.61 | 0.58 | 0.56 | 0.57 | 0.58 | 0.57 |

TABLE 5

| | | | Example | | | | | | | | |
|---|---|---|---|---|---|---|---|---|---|---|---|
| | | | 28 | 29 | 30 | 31 | 32 | 33 | 34 | 35 | 36 |
| Finish component | Polyether compound | EO-PO compound (1) | 58 | 57 | 58.5 | 58.5 | 58 | 57 | 58 | 57 | 64 |
| | | EO-PO compound (2) | 10 | 10 | 10 | 10 | 10 | 10 | 10 | 10 | 10 |
| | | EO-PO compound (3) | 10 | 10 | 10 | 10 | 10 | 10 | 10 | 10 | 10 |
| | Component (A) | Potassium lactate | 1 | 2 | 0.5 | | | | 0.5 | 0.5 | 0.5 |
| | | Potassium acetate | | | | 0.5 | | | | | |
| | | Potassium pelargonate | | | | | 1 | | | | |
| | | Potassium oleoyl sarcosinate | | | | | | 2 | | | |
| | Component (B) | Potassium $C_{12}$-$C_{14}$ alkyl phosphate | 0.5 | 0.5 | 0.5 | | 0.5 | 0.5 | 0.5 | 0.5 | 0.5 |
| | | POE(3) potassium $C_{12}$-$C_{14}$ alkyl phosphate | | | | 0.5 | | | | | |
| | Component (C) | Potassium alkenyl succinate | 0.5 | 0.5 | 0.5 | 0.5 | 0.5 | 0.5 | 1 | 2 | |
| | Others | 2-ethylhexyl laurate | | | | | | | | | 5 |
| | | POE(8) $C_{12}$-$C_{14}$ alkyl $C_{10}$ etherester | 10 | 10 | 10 | 10 | 10 | 10 | 10 | 10 | |
| | | POE(9) $C_{12}$-$C_{14}$ alkyl ether | 10 | 10 | 10 | 10 | 10 | 10 | 10 | 10 | 10 |
| Testing | Ends down frequency (contact heater) | | medium | medium | medium | medium | medium | medium | medium | medium | medium |
| | Stain on contact heater | | Δ | Δ | Δ | Δ | Δ | Δ | Δ | Δ | Δ |
| | Finish flowability at initial stage of heating | | Δ | Δ | Δ | Δ | Δ | Δ | Δ | Δ | Δ |
| | Finish residue after heating (wt %) | | 2.5 | 2.9 | 1.8 | 1.8 | 1.3 | 1.4 | 1.4 | 1.7 | 1.2 |
| | Ends down frequency (non-contact heater) | | low | low | low | low | low | low | low | low | low |
| | Yarn-to-smooth chrome pin static frictional coefficient | | 0.58 | 0.58 | 0.57 | 0.58 | 0.59 | 0.56 | 0.57 | 0.59 | 0.58 |

TABLE 6

| | | | Comparative example | | | | | |
|---|---|---|---|---|---|---|---|---|
| | | | 6 | 7 | 8 | 9 | 10 | 11 |
| Finish component | Polyether compound | EO-PO compound (1) | 64 | 64.5 | 64.5 | 58.5 | 63.5 | 63.5 |
| | | EO-PO compound (2) | 10 | 10 | 10 | 10 | 10 | 10 |
| | | EO-PO compound (3) | 10 | 10 | 10 | 10 | 10 | 10 |
| | Component (A) | Potassium lactate | 0.5 | | | | | |
| | | Potassium acetate | | | | 1 | | |
| | | Potassium pelargonate | | | | | 1 | |
| | | Potassium oleyl sarcosinate | | | | | | 1 |
| | Component (B) | Potassium $C_{12}$-$C_{14}$ alkyl phosphate | | 0.5 | | | | |
| | | POE(3) potassium $C_{12}$-$C_{14}$ alkyl phosphate | | | 0.5 | | | |
| | Component (C) | Potassium alkenyl succinate | 0.5 | | | 0.5 | 0.5 | 0.5 |
| | Others | 2-ethylhexyl laurate | 5 | 5 | 5 | | 5 | 5 |
| | | POE(8) $C_{12}$-$C_{14}$ alkyl $C_{10}$ etherester | | | | 10 | | |
| | | POE(9) $C_{12}$-$C_{14}$ alkyl ether | 10 | 10 | 10 | 10 | 10 | 10 |

TABLE 6-continued

| | | Comparative example | | | | | |
|---|---|---|---|---|---|---|---|
| | | 6 | 7 | 8 | 9 | 10 | 11 |
| Testing | Ends down frequency (contact heater) | high | high | high | high | high | high |
| | Stain on contact heater | Δ | X | X | Δ | Δ | Δ |
| | Finish flowability at initial stage of heating | X | X | X | X | X | X |
| | Finish residue after heating (wt %) | 2.0 | 1.3 | 1.5 | 2.0 | 2.1 | 2.0 |
| | Ends down frequency (non-contact heater) | high | low | low | high | high | high |
| | Yarn-to-smooth chrome pin static frictional coefficient | 1.54 | 0.58 | 0.61 | 1.76 | 1.77 | 1.81 |

The components described in Tables 1 to 6 represent the following chemicals.

EO-PO compound (1): Polyether compound of random EO/PO (50:50) copolymer with a M.W. of 1500, capped with a $C_{12}$-$C_{13}$ alcohol (NEODOL 23, produced by Shell Chemicals) on one end EO-PO compound (2): Polyether compound of block EO/PO (40:60) copolymer with a M.W. of 1500, capped with a $C_8$ alcohol on one end EO-PO compound (3): Polyether compound of random EO/PO (50:50) copolymer with a M.W. of 5000

Modified silicone: Silicone FZ-2123 (produced by Dow Corning Toray)

POE (3) potassium $C_{12}$-$C_{14}$ alkyl phosphate: phosphate of POE (3) $C_{12}$-$C_{14}$ secondary ether Potassium alkenyl succinate: potassium salt represented by the formula (5) where q=1, r=1, and $R^5$ is a dodecenyl group POE (9) $C_{12}$-$C_{14}$ alkyl ether: SOFTANOL 90 (produced by Nippon Shokubai Co., Ltd.)

As shown in Tables 1 to 6, the finish for friction false-twist texturing of the present invention which is applied to synthetic filament yarn in a certain amount greatly decreases ends down in false-twist texturing, and prevents stain on the surface of contact-type heaters of draw-texturing machines.

INDUSTRIAL APPLICABILITY

The finish for friction false-twist texturing of the present invention is especially suitable for yarns of synthetic filament including polyester filament, polyamide filament, and polypropylene filament to be processed in false-twist texturing.

What is claimed is:

1. A finish for synthetic filament yarn processed in friction false-twist texturing, the finish comprising 30 to 98 wt % of a polyether compound and essentially comprising a component (A) and a component (B);

wherein the component (A) is at least one kind of a metal salt or amine salt of a component selected from the group consisting of a component (A1) comprising an acetic acid and/or butanoic acid, a component (A2) comprising a compound represented by the following formula (2), and a component (A3) comprising a sarcosine derivative, and the amount of the component (A) in the finish ranges from 0.05 to 5 wt %; and wherein the component (B) is an alkylphosphate salt and the amount of the component (B) in the finish ranges from 0.01 to 3 wt %

[Formula 2]

$$R^2—(CH)(OH)—COOH \quad (2)$$

where $R^2$ is a hydrogen atom, a $C_1$-$C_4$ alkyl group or a $C_1$-$C_4$ alkenyl group.

2. The finish for synthetic filament yarn processed in friction false-twist texturing according to claim 1, wherein the finish further comprises a component (C) comprising an aliphatic dibasic acid and/or its salt, and the amount of the component (C) in the finish ranges from 0.01 to 3 wt %.

3. The finish for synthetic filament yarn processed in friction false-twist texturing according to claim 1, wherein the component (A3) is represented by the following formula (3):

[Formula 3]

$$R^3—N(CH_3)—CH_2—COOH \quad (3)$$

where $R^3$ is a hydrogen atom, a $C_1$-$C_{34}$ alkyl group, a $C_1$-$C_{34}$ alkenyl group or a $C_1$-$C_{34}$ acyl group.

4. The finish for synthetic filament yarn processed in friction false-twist texturing according to claim 1, wherein the component (A) comprises a metal salt or amine salt of the component (A2).

5. The finish for synthetic filament yarn processed in friction false-twist texturing according to claim 1, wherein the component (B) comprises an alkyl phosphate salt of a $C_8$-$C_{32}$ alcohol or an alkyl phosphate salt of an alkylene oxide adduct produced by bonding 1 mole of the $C_8$-$C_{32}$ alcohol with 1 to 20 moles of alkylene oxide.

6. The finish for synthetic filament yarn processed in friction false-twist texturing according to claim 2, wherein the aliphatic dibasic acid is a compound represented by the following formula (4):

[Formula 4]

$$HOOC—(CH_2)_q—(CHR^4)_r—COOH \quad (4)$$

where $R^4$ is a hydrogen atom, alkyl group or alkenyl group; q is an integer ranging from 0 to 9; and r is 0 or 1.

7. The finish for synthetic filament yarn processed in friction false-twist texturing according to claim 1, wherein the polyether compound is an EO/PO copolymer having an EO/PO molar ratio ranging from 80:20 to 10:90 and an average molecular weight ranging from 200 to 20,000.

8. The finish for synthetic filament yarn processed in friction false-twist texturing according to claim 1, wherein the finish further comprises (D) a modified silicone and the amount of the component (D) in the finish ranges from 0.05 to 5 wt %.

9. The finish for synthetic filament yarn processed in friction false-twist texturing according to claim 8, wherein the component (D) is a compound represented by the following formula (5):

[Formula 5]

(5)

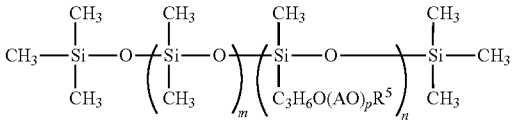

were $R^5$ is a hydrogen atom, alkyl group or alkenyl group; A is a $C_2$-$C_4$ alkylene group; m and n are integers that satisfy the expression, m+n=1 to 30; and p is an integer ranging from 3 to 35.

10. The finish for synthetic filament yarn processed in friction false-twist texturing according to claim 1, wherein the synthetic filament yarn comprises polyester filament, polyamide filament, or polypropylene filament.

11. A finish emulsion for finish application prepared by dispersing the finish for friction false-twist texturing according to claim 1 in water to make an oil-in-water emulsion.

12. A synthetic filament yarn prepared by applying the finish for friction false-twist texturing according to claim 1 to a filament yarn in an amount ranging from 0.1 to 5 wt % of the filament yarn weight.

13. A process for manufacturing a synthetic filament yarn comprising a step of applying the finish for friction false-twist texturing according to claim 1 to filament yarn.

14. A synthetic filament yarn manufactured by heating, drawing, and false-twist texturing the synthetic filament yarn according to claim 12.

15. A process for manufacturing a synthetic filament yarn comprising a step of applying the finish for friction false-twist texturing according to the finish emulsion of claim 11 to filament yarn.

16. A synthetic filament yarn manufactured by heating, drawing, and false-twist texturing the synthetic filament yarn manufactured in the process according to claim 13.

* * * * *